US007375686B2

(12) United States Patent
Ku et al.

(10) Patent No.: US 7,375,686 B2
(45) Date of Patent: May 20, 2008

(54) PLANAR INVERTED F ANTENNA AND METHOD OF MAKING THE SAME

(75) Inventors: Po-Kang Ku, Tu-Cheng (TW); Lung-Sheng Tai, Tu-Cheng (TW); Chen-Ta Hung, Tu-Cheng (TW); Yun-Long Ke, Tu-Cheng (TW); Yao-Shien Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/491,602

(22) Filed: Jul. 24, 2006

(65) Prior Publication Data

US 2007/0018892 A1 Jan. 25, 2007

(30) Foreign Application Priority Data

Jul. 22, 2005 (CN) ..... 2005 1 0041153

(51) Int. Cl.
*H01Q 1/38* (2006.01)
*H01Q 21/00* (2006.01)
*H01Q 9/38* (2006.01)

(52) U.S. Cl. ..... 343/700 MS; 343/725; 343/830

(58) Field of Classification Search ..... 343/700 MS, 343/702, 829, 830, 846, 725
See application file for complete search history.

(56) References Cited

U.S. PATENT DOCUMENTS

| | | | | |
|---|---|---|---|---|
| 6,600,448 | B2 | 7/2003 | Ikegaya | |
| 6,844,853 | B2 * | 1/2005 | Tai et al. | 343/700 MS |
| 6,847,329 | B2 | 1/2005 | Ikegaya | |
| 6,891,504 | B2 | 5/2005 | Cheng | |
| 6,897,810 | B2 * | 5/2005 | Dai et al. | 343/700 MS |
| 2004/0178957 | A1 * | 9/2004 | Chang et al. | 343/700 MS |

* cited by examiner

*Primary Examiner*—Shih-Chao Chen
(74) *Attorney, Agent, or Firm*—Wei Te Chung

(57) ABSTRACT

A multi-band antenna (1) used in wireless communications includes a radiating portion (2), a grounding portion (4), and a connecting portion (3). The radiating portion (2) includes a first radiating element (21) operating at 900 MHz frequency band and a second radiating element (22) operating at 1800 MHz frequency band. The connecting portion (3) connects the radiating portion (2) and the grounding portion (4). The grounding portion (4), the radiating portion (2), and the connecting portion (3) locate in the same plane.

20 Claims, 6 Drawing Sheets

PLANAR INVERTED F ANTENNA AND METHOD OF MAKING THE SAME

BACKGROUND OF THE INVENTION

1. Field of the Invention

The present invention relates generally to an antenna, and more particularly to a planar inverted-F antenna (PIFA) used in a portable electronic device.

2. Description of the Prior Art

With the development of wireless communication, more and more portable electronic devices, for example note book, install an antenna system for working in a Wireless Local-area Network (WLAN). Transmitting and receiving signals plays an important role in wireless communication process. In recent years, a majority of WLAN bases on Bluetooth technical standard or 802.11 technical standard. Antenna in Bluetooth technical standard bases on 2.4 GHz frequency band, and in 802.11 technical standard bases on 2.4 GHz and 5 GHz. So, antenna in notebook mostly works in the above frequency bands at the present time.

However, user would not satisfy a portable wireless communication devices only working in WLAN in the future. It's desired to make portable wireless communication device working in Wireless Wide-area Network (WWAN). The portable wireless communication device working in WWAN can work and entertain in more broad area. WWAN adopts two techniques, GSM and CDMA at present. However, a portable wireless communication device can work in GSM unless it has an antenna working in the frequency band of GSM. Antennas in notebook and other portable wireless communication device mostly work in 2.4 GHz frequency and 5 GHz frequency now. However, antennas of the mobile phone working in GSM mostly cannot be set in notebook or other portable wireless communication device because of size or power.

For example, China Patent No. 2689482Y discloses a PIFA capable of working on three frequency bands. The antenna includes three radiating elements, respectively operating at 1800 GHz, 900 MHz, and 2450 MHz. So, the antenna can be set in notebook or other portable wireless communication device for working in GSM. However, this antenna adopts solid structure, that is, the radiating elements, connection element, and grounding element respectively locate in different planes. Complex configuration and taking up more space result in the antenna going against industrialization manufacture, wasting cost and breaching trend of miniaturization development of antenna.

Hence, in this art, a planar inverted-F antenna to overcome the above-mentioned disadvantages of the prior art will be described in detail in the following embodiment.

BRIEF SUMMARY OF THE INVENTION

A primary object, therefore, of the present invention is to provide a planar inverted-F antenna with simplified structure and reduced size.

A second object, therefore, of the present invention is to provide a method of manufacturing the antenna above.

In order to implement the above object and overcomes the above-identified deficiencies in the prior art, the planar inverted F antenna forming in a metal patch, comprises a first radiating element and extending in a first direction, a second radiating element and extending in a second direction different from the first direction, a grounding portion and spacing with the first radiating element and the second radiating element, an connecting portion connecting the first and the second radiating elements and the grounding portion, and a feeder line comprising a inner conductor for attaching to the connecting portion and a outer conductor for attaching to the grounding portion. The first radiating element has a first radiating portion and a second radiating portion being perpendicular to the first radiating portion. The connecting portion comprises a first portion, a second portion paralleling the first portion and s third portion connecting the first portion and the second portion.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
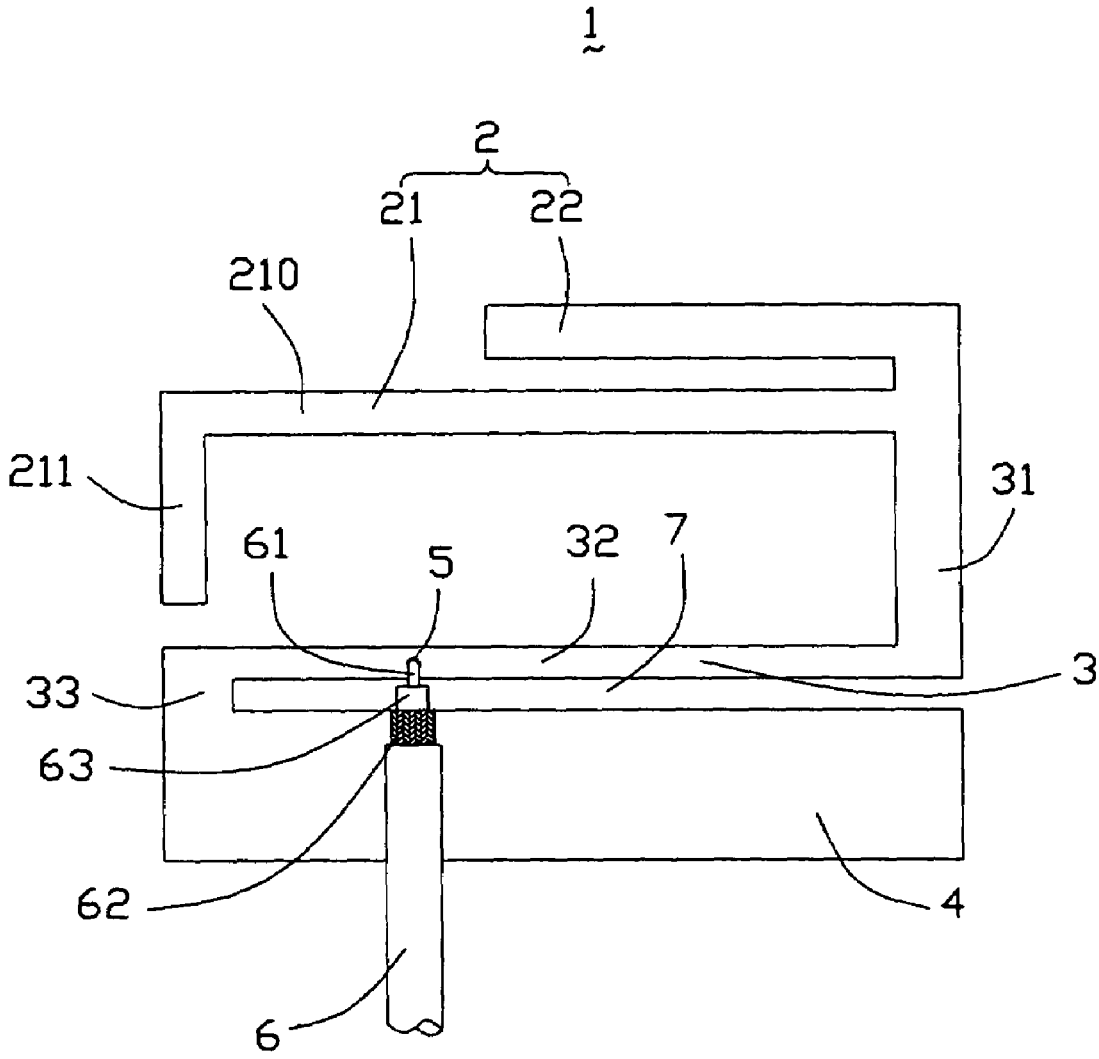
FIG. 1 is a top elevation view of a planar inverted-F antenna in accordance with the present invention.
Figure 2:
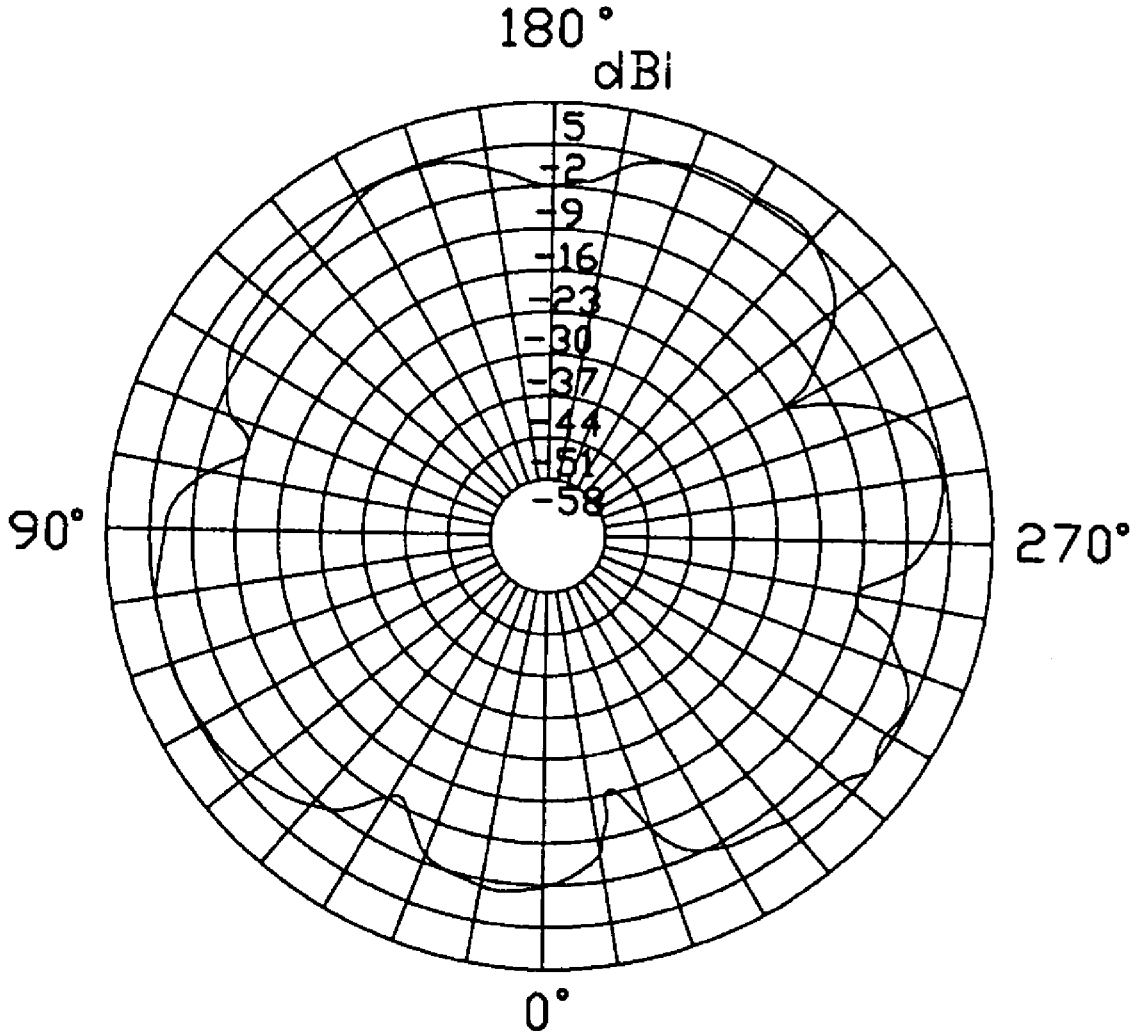
FIG. 2 is a horizontally polarized principle plane radiation pattern of the antenna operating at the resonant frequency of 900 MHz.
Figure 3:
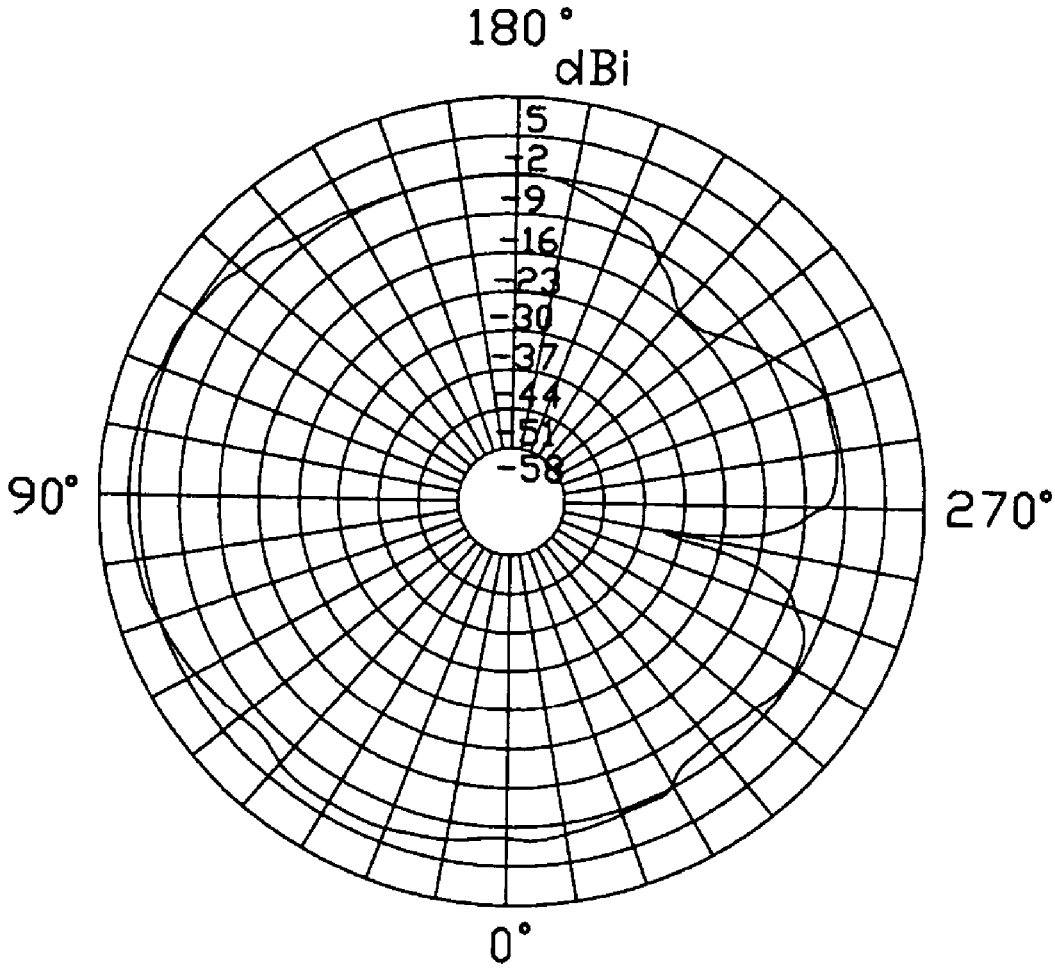
FIG. 3 is a vertically polarized principle plane radiation pattern of the antenna operating at the resonant frequency of 900 MHz.
Figure 4:
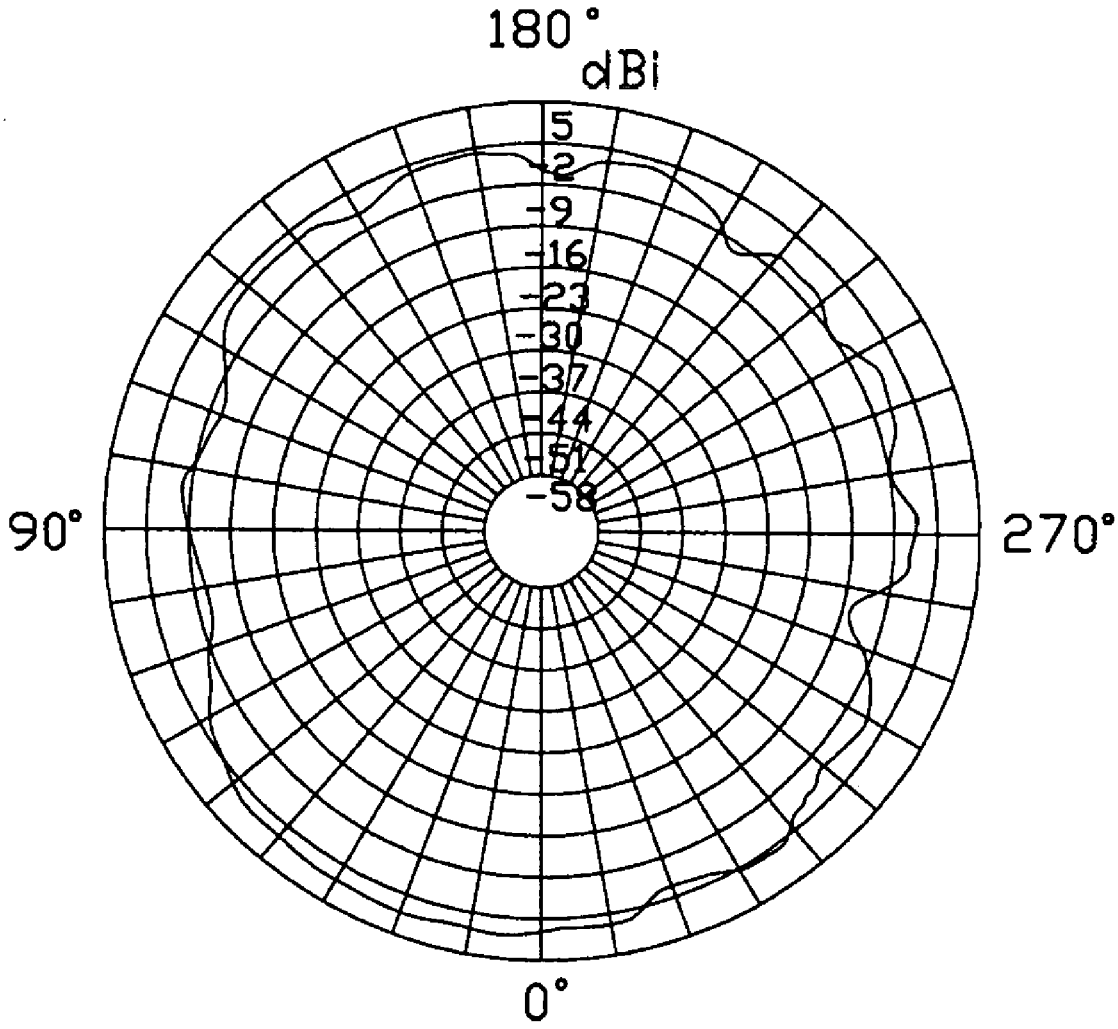
FIG. 4 is a horizontally polarized principle plane radiation pattern of the antenna operating at the resonant frequency of 1800 MHz.
Figure 5:
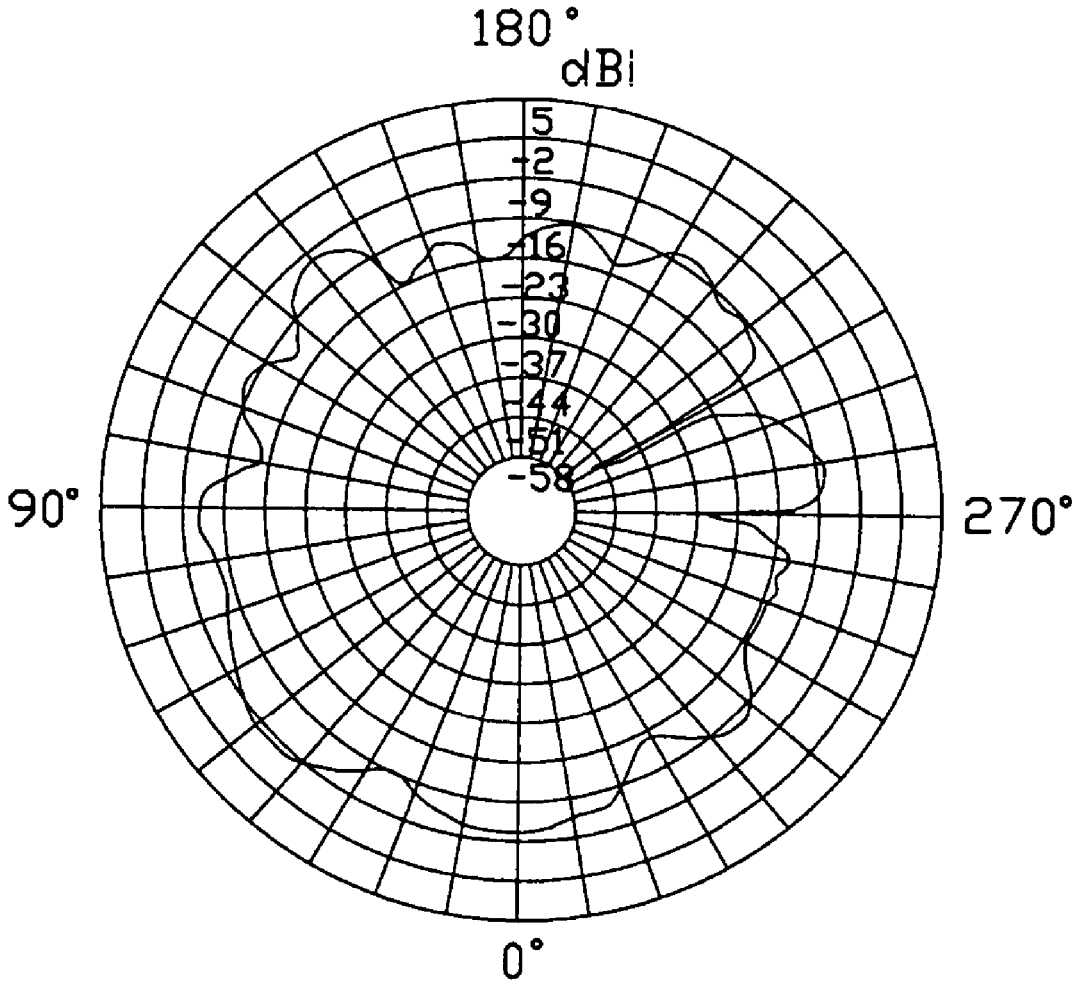
FIG. 5 is a vertically polarized principle plane radiation pattern of the antenna operating at the resonant frequency of 5.1800 MHz.

Referring to FIG. 1, a planar inverted-F antenna 1 according to the present invention is made of a metal sheet and comprises a radiating portion 2, a grounding portion 4, and a connecting portion 3 connecting the radiating portion 2 and the grounding portion 4.

The radiating portion 2 comprises a first radiating element 21 operating at a lower frequency and a second radiating element 22 operating at a higher frequency and extending along a first direction. The first radiating element 21 is of L-shape and comprises a first part 210 extending along the first direction and parallel to the second radiating element 22 and a second part 211 extending along a second direction from left end of the first part 210 toward the grounding portion 4. The L-shape design of the first radiating element 21 is capable of avoiding adding the lateral size of the planar inverted-F antenna 1. The connecting portion 3 comprises a first side section 31 parallel to the second part 211 of the first radiating element 21 and connecting the first radiating element 21 and the second radiating element 22, a second side section 32 extending along the first direction from a lower end of the first side section 31 toward the second part 211, and a third side section 33 extending along the second direction from left end of the second side section 32 to terminate the second side section 32 with the grounding portion 4, respectively. The grounding portion 4 is a rectangular piece connecting the third side section 33 and parallel to the second side section 32. A feeding point 5 locates on the second side section 32 near the third side section 33. A feeding line 6 extends from feeding point 5 and connects the grounding portion 4. The feeding line 6 comprises an inner conductor 61 soldered to the feeding point 5, an inner insulating layer 63 enclosing the inner conductor 61, a metal braiding layer 62 soldered to the grounding portion 4 and an outer insolating layer (not labeled).

The second, third side sections 32, 33 of the connecting portion 3 and a longer edge of the grounding portion 4 together form a slot 7 with width equal to the length of the third side section 33. High frequency of the second radiating portion 22 can arrive at a more wider frequency band and a more better radiation impression by changing the width of the slot 7 i.e. the length of the third side section 33 and location of the feeding point 5.

The first radiating element 21, the connecting portion 3, and the grounding portion 4 together form a first planar inverted-F antenna receiving and transmitting lower frequency signal. The second radiating portion 22, the connecting portion 3, and the grounding portion 4 form a second planar inverted F antenna receiving and transmitting higher frequency signal.

FIGS. 2-5 show the horizontally polarized and vertically polarized principle plane radiation patterns of the antenna 1 operating at the resonant frequency of 900 MHz and 1800 GHz. Note that each radiation pattern of the planar inverted-F antenna 1 is close to corresponding optimal radiation pattern and there is no obvious radiating blind area, conforming to the practical use conditions of an antenna.

Figure 6:
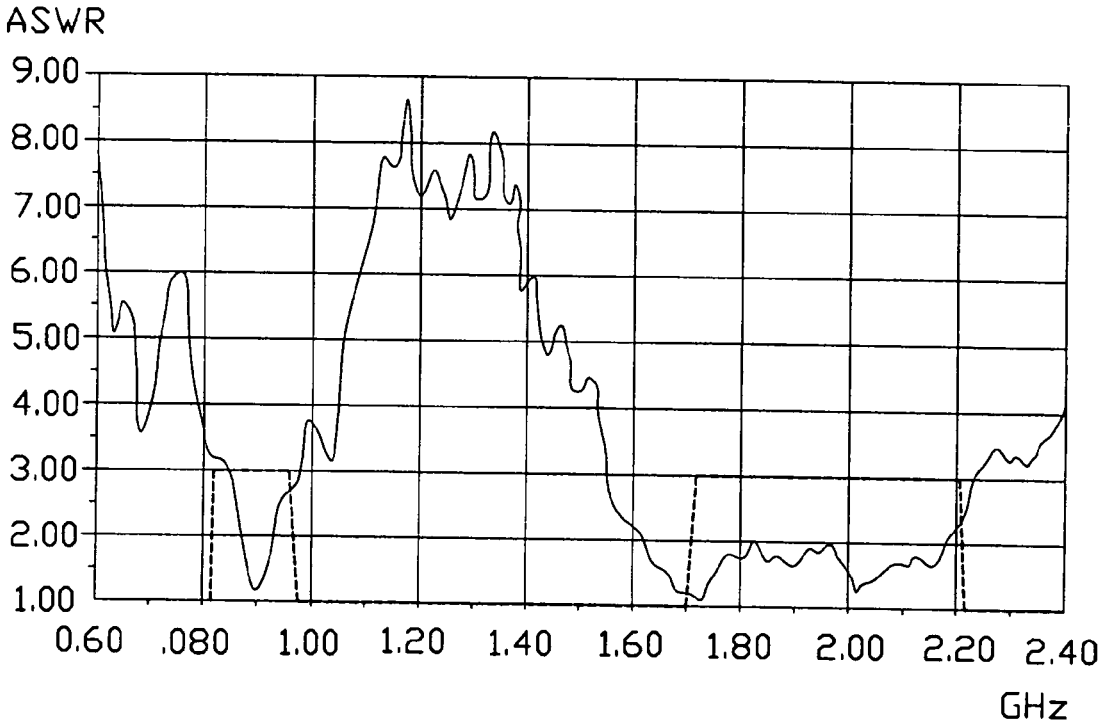
FIG. 6 is a test chart recording of Voltage Standing Wave Ratio (VSWR) of the inverted-F antenna as a function of frequency.

Referring to FIG. 6, sets forth a test chart recording of Voltage Standing Wave Ratio (VSWR) of the antenna 1 as a function of frequency. Note that VSWR drops below the desirable maximum value "2" in the 880 M-920 MHz frequency band and in the 1710-2180 MHz frequency band, indicating acceptable efficient operation in these two wide frequency bands, which cover more than the total bandwidth of GSM (low frequency band includes 880-960 MHz, high frequency band includes 1710-1880 MHz) and be provided with more wider frequency band of the operating at high frequency.

The method of making the same of the planar inverted-F antenna 1 of the present invention comprises following steps. Firstly, selecting a rectangle metal piece. Secondly, calculating a required length of the radiating portion 2 according to the bands of 900 MHz and 1800 MHz. Thirdly, calculating a length and shape of the connecting portion 3 according to required impendence matching. Fourth, achieving the radiating portion 2, the connecting portion 3, and the grounding portion 4 by digging slots in the rectangle metal piece according to the calculations. Fifth, calculating the location of the feeding point 5 and providing the feeding line 6 connecting to the feeding point 5 according to impendence matching.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A planar inverted-F antenna adapted for used in an electronic device, comprising:

a grounding portion;

a radiating portion comprising a first radiating element substantially operating around 900 MHz frequency band and a second radiating element substantially operating around 1800 MHz frequency band; and a connecting portion connecting the radiating portion and the grounding portion; and wherein the grounding portion, the radiating portion, and the connecting portion locate in the same plane; wherein the first radiating element and the second radiating element parallel to each other and extend along a first direction; wherein the connecting portion comprises first, second, and third side sections connecting with one another in turn; wherein said first side section is electrically connected to a joint of said first and second radiating elements, said first and second radiating elements extend along said first direction both from the first side section.

2. The planar inverted-F antenna as claimed in claim 1, wherein the first radiating element is of L-shape and comprises a first part parallel to the second radiating element and a second part extending along a second direction and being perpendicular with the first part.

3. The planar inverted-F antenna as claimed in claim 1, wherein said first side section is electrically connected to said radiating portion, said third side section being offset from said first side section and being electrically connected to said grounding portion, said second side section electrically interconnecting said first and third side sections.

4. The planar inverted-F antenna as claimed in claim 3, wherein the outer edges of said third side section, said grounding portion, and said second part locate in one straightness line.

5. The planar inverted-F antenna as claimed in claim 1, wherein the second side section, the third side section, and the grounding portion together form a modulating slot.

6. The planar inverted-F antenna as claimed in claim 3, wherein a feeding point is adjustably located on the second side section.

7. The planar inverted-F antenna as claimed in claim 6, further comprising a feeding line comprising an inner conductor electrically connected to said feeding point and a braiding layer electrically connected to said grounding portion.

8. A method of making a planar inverted-F antenna comprising the following steps:

a) choosing a rectangle metal piece;

b) calculating a required length of a radiating portion, the radiating portion composing a first radiating element substantially operating around 900 MHz and a second radiating element substantially operating round 1800 MHz of the planar inverted-F antenna;

c) calculating a length and shape of a connecting portion of the planar inverted-F antenna according to requiring impendence matching;

d) achieving the radiating portion, the connecting portion, and a grounding portion of the planar inverted-F antenna by digging slots in the rectangle metal piece according to said calculations; and e) calculating the location of a feeding point and providing a feeding line be electrically connected to the feeding point according to said impendence matching; wherein the connecting portion comprises first, second, and third side sections electrically connecting with one another in turn; wherein said first side section be electrically connected to a joint of said first and second radiating elements, said first and second radiating elements extend along said first direction.

9. The method of making the planar inverted-F antenna as claimed in claim 8, wherein the second radiating element extends along a first direction, the first radiating element is of L-shape and comprises a first part parallel to the second element and a second part extend along a second direction being perpendicular to the first direction.

10. The method of making the planar inverted-F antenna as claimed in claim 8, wherein said first side section being electrically connected to said radiating portion, said third side section being offset from said first side section and being electrically connected to said grounding portion, said second side section electrically interconnecting said first and third side sections.

11. The method of making the planar inverted-F antenna as claimed in claim 8, wherein the outer edges of said third side section, said grounding potion, and said second part locate in one straightness line.

12. The method of making the planar inverted-F antenna as claimed in claim 11, wherein the second side section, the third side section, and the grounding portion together form a modulating slot.

13. The method of making the planar inverted-F antenna as claimed in claim 10, wherein the feeding point is adjustably located on the second side section; further providing a feeding line comprising a inner conductor electrically connected to said feeding point and a braiding layer electrically connected to said grounding portion.

14. An antenna comprising:

a ground portion;

a low frequency radiation portion and a high frequency radiation portion essentially distantly respectively located beside the ground portion in a parallel relation thereto, the low frequency radiation portion being closer to the ground portion than the high frequency radiation portion;

a multiple sectional connection portion linked between the ground portion and the low frequency radiation portion;

a feeder cable including an inner conductor mechanically and electrically connected to the connection portion, and an outer conductor mechanically and electrically connected to the ground portion.

15. The antenna as claimed in claim 14, wherein the low frequency radiating portion further extends at least with one section angled to the ground portion within a space formed between the low frequency radiation portion and the ground portion.

16. The antenna as claimed in claim 14, wherein said connection defines a Z-shaped configuration having an end region connected to the ground portion and the other connected to a common area where both said low frequency radiation portion and said high frequency radiation portion are connected.

17. The antenna as claimed in claim 16, wherein said low frequency radiation portion is composed of an L-shaped configuration.

18. The antenna as claimed in claim 16, wherein said L-shaped configuration including a long section and a short section under a condition that the long section extends along a direction parallel to the high frequency radiation portion, and a short section extending perpendicular to said long section.

19. The antenna as claimed in claim 18, wherein said long section extends with a length similar to a dimension of said ground portion along said direction.

20. The antenna as claimed in claim 14, further including a first slot defined between the ground portion and the connection portion and open to a first lateral side, a second slot defined between the connection portion and the low frequency radiation portion and open to a second lateral side opposite to the first lateral side, and a third slot defined between the low frequency radiation portion and the high frequency radiation portion and open to said second lateral side.

* * * * *